United States Patent [19]

Willenbacher et al.

[11] Patent Number: 4,589,363

[45] Date of Patent: May 20, 1986

[54] SEWING MACHINE FOR AUTOMATICALLY MAKING EDGE-PARALLEL SEAMS

[75] Inventors: Erich Willenbacher, Kaiserslautern; Fritz Jehle, Enkenbach-Alsenborn, both of Fed. Rep. of Germany

[73] Assignee: Pfaff Industriemaschinen GmbH, Fed. Rep. of Germany

[21] Appl. No.: 779,491

[22] Filed: Sep. 24, 1985

[30] Foreign Application Priority Data

Oct. 6, 1984 [DE] Fed. Rep. of Germany ..... 3436771

[51] Int. Cl.[4] ..... D05B 27/08; D05B 35/10

[52] U.S. Cl. ..... 112/308; 112/272; 112/275; 112/153; 112/315

[58] Field of Search ..... 112/308, 309, 153, 274, 112/275, 272, 315

[56] References Cited

U.S. PATENT DOCUMENTS

| | | | |
|---|---|---|---|
| 3,139,051 | 6/1964 | Story | 112/308 |
| 3,425,369 | 2/1969 | Kosrow | 112/309 X |
| 4,312,286 | 1/1982 | Biotteau | 112/315 X |
| 4,491,080 | 1/1985 | Hager | 112/275 |
| 4,495,877 | 1/1985 | Willenbacher | 112/275 X |
| 4,526,117 | 7/1985 | Willenbacher | 112/308 |
| 4,528,923 | 7/1985 | Hager | 112/275 |

*Primary Examiner*—H. Hampton Hunter

*Attorney, Agent, or Firm*—McGlew and Tuttle

[57] ABSTRACT

A sewing machine for automatically making edge-parallel seams comprises a scanning device for recognizing the geometric form of the workpiece edge and a pressure piston lowerable laterally of the stitch formation point. For straight workpiece edges extending at an angle to each other, the pressure piston, having been lowered onto the workpiece with the sewing machine stopped, is rotated around the needle which is inserted in the workpiece, the workpiece being taken along accordingly. For a convexly arcuate edge pattern, first the lateral distance of the pressure piston from the needle is readjusted in such a way that it corresponds to the radius of the edge arc (e.g. scallop). Thereafter, with the sewing machine continuing to run, the pressure piston is lowered, whereupon the feed dog of the sewing machine rotates the workpiece around the pressure piston.

10 Claims, 4 Drawing Figures

54
55
50
53
35
51
32
37
33
43
41
42
52
64
66
39
40
65
38
31
45
34
3
36
44
104
73
72
1
87
86
85
84
83
80
2
46
4
47
8
9
48
5
49
10
12
6
7
13

70
50
68
45
32
69
1
54
39
31
52
43
33
34
104
72
41
V
82
74
6
75
87
86
85
84
83
73
79
77
80

INPUT
M.P.
30

SEWING MACHINE FOR AUTOMATICALLY MAKING EDGE-PARALLEL SEAMS

FIELD AND BACKGROUND OF THE INVENTION

The present invention relates in general to sewing machines and in particular to a new and useful sewing machine which includes a mechanism for automatically making edge-parallel seams by using a piston which can be lowered onto a workpiece to either actively rotate the workpiece about an axis of the needle or passively hold the workpiece while the workpiece is moved by a feed dog acting on the bottom of the workpiece.

U.S. Pat. No. 4,526,117 to Willenbacher shows a sewing machine with a pressure piston for the edge-parallel sewing of outer scallops, which is placed on the workpiece and is controlled by a scanning device with the sewing machine running. At that point a feed dog of the machine which continues to operate, rotates the workpiece about the pressure piston serving as brake means and holds it in abutment at the relatively narrow guide ruler. For the edge-paralell sewing of inner scallops, the guide ruler alone serves to perform the rotary movement of the workpiece, in that the workpiece braces itself on the guide ruler and in so doing is pushed away laterally, whereby it executes a clockwise rotation at least in the region of the stitch formation point. With this type of sewing machine, however, only workpieces with alternately straight and arcuate edges can be worked automatically. If, on the contrary, the workpiece has angular edges, the corner-shaped seam section cannot be sewn automatically. Instead, the sewing machine must be stopped with the needle inserted in the corner point of the seam and the workpiece must then be rotated around the needle by hand. It is noted that U.S. Pat. No. 4,526,117 has the same inventor and assignee as the present application.

From U.S. Pat. No. 3,425,369 to Kosrow, a sewing system is known which serves for the automatic edge-parallel sewing of workpieces with workpiece edges meeting at an acute angle. For this purpose, the sewing system comprises a workpiece rotating device with a tappet lowerable onto the workpiece, the size of the angle of rotation being determined by a scanning device responding to the workpiece edge. The workpiece hangs down over the edge of a narrow, substantially arcuate cloth supporting plate, and due to the friction at this edge it experiences during the forward movement a rotational moment or torque by which it is pushed against a guide ruler. Before the stitch formation point, a plate provided with a spring element is arranged at a lever. When resting on the workpiece, the plate and the spring element supplement the action of the presser foot. In addition, the plate has an aligning action on the workpiece. This aligning effect presumably comes about through the fact that the plate exerts on the workpiece passing under it, a brake force which, due to the position of the plate slightly offset laterally relative to the stitch formation point, exerts on the workpiece a rotatational moment which additionally supports the rotational moment caused by the friction at the edge of the cloth supporting plate. By means of such an arrangement, whose aligning action comes about in the case of outer scallops by a relative movement between workpiece and brake means, workpieces with narrow radii can, however, be controlled only quite inaccurately.

SUMMARY OF THE INVENTION

An object of the present invention is to provide a sewing machine which makes possible an automatic guiding and aligning of workpieces with straight, angular and/or arcuate edge pattern, where the arcuate edges may also have narrow radii.

By using a pressure piston both as a passive guide element and as an active control element according to the invention, the various functions are carried out by one and the same structural element, whereby the engineering effort for the machine is reduced.

Another object of the invention is to support the pressure piston so that it is pivotable about the axis of the needle and driven by a second setting mechanism for rotating the pressure piston about the axis of the needle. In this way, the pressure piston can, before being placed on the workpiece, be moved into a position such that after the lowering operation it is located in the radius point of a convexly arcuate edge section, so that the feed dog, continuing to operate with the sewing machine running, can swivel the workpiece about the pressure piston, which in this case forms the axis of rotation.

According to a still further object of the invention, a scanning device for determining the geometric form of the workpiece edge has a measuring field extending crosswise to the feed direction of the workpiece and comprises several measuring points. The scanning device is connected to a microprocessor which evaluates measured data from the scanning device and is operable to control the setting means for moving the pressure piston. This makes it possible to directly determine the geometric form of the edge section of the workpiece present in front of the stitch formation point and the setting means for the operation of the pressure piston are actuated in corresponding manner. Thus workpieces with different edge patterns can be worked successively without transposition, reprogramming or change of sewing programs in direct succession.

A still further object of the invention is to provide a sewing machine with positioning device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The invention is explained with reference to an embodiment illustrated in the drawing, in which.

DESCRIPTION OF THE PREFERRED EMBODIMENT

Figure 1:
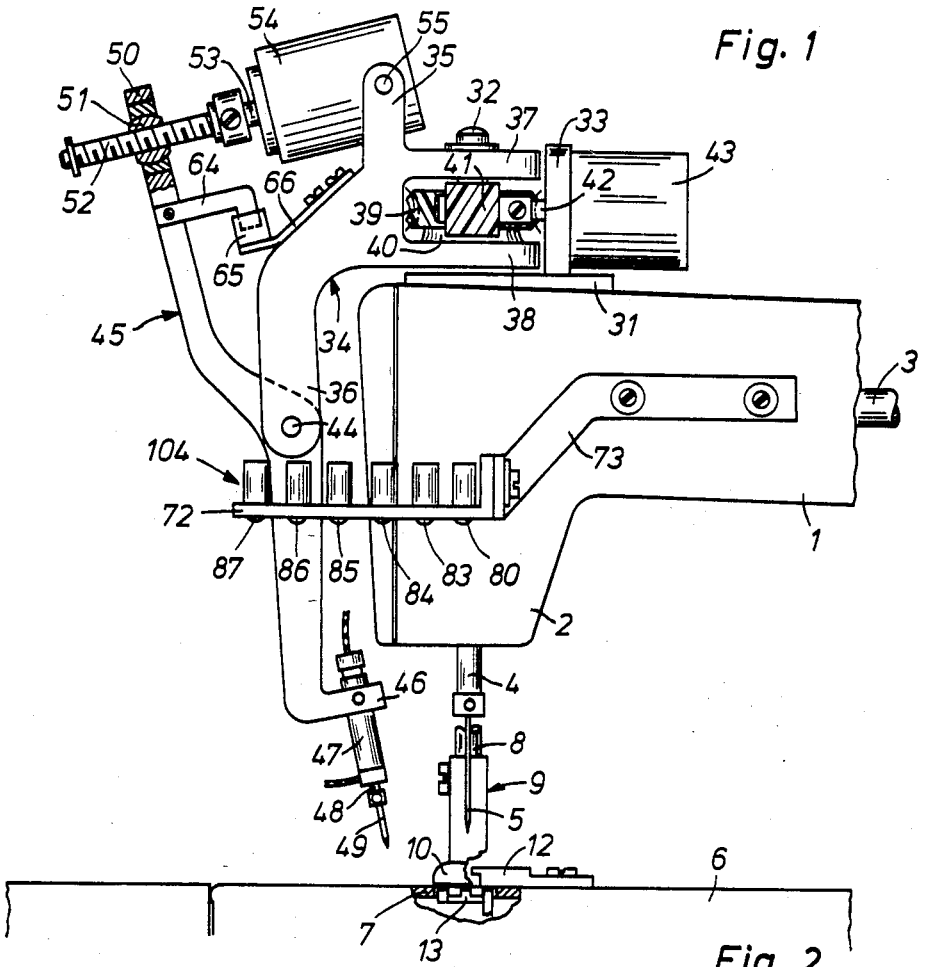
FIG. 1 is a simplified partial view of a sewing machine with the pressure piston and the setting means associated with it.

The sewing machine, shown only in part in FIG. 1, has an arm 1 and a head 2. A main shaft 3 mounted in arm 1 drives in known manner, via a crank, (not shown) a needle bar 4, which carries a thread guiding needle 5. Cooperating with needle 5 is a looper or shuttle (not shown) which is arranged in the base plate 6 of the sewing machine below a stitch plate 7. A sewing foot 9 is fastened on a presser bar 8 mounted in head 2. The sole 10 of foot 9 has, according to FIG. 4 a lateral cutout 11. On the base plate 6 a guide ruler 12 is adjustably fastened, whose one end engages in the cutout 11.

In the base plate 6 a feed dog 13 is disposed, to which rectangular movements are imparted in known manner by a transmission (not shown). The transmission corresponds to the transmission of the sewing machine according to German OS No. 32 16 993 composed of the elements 27 to 41. Connected to the transmission is a known stitch setting device 14 shown in FIG. 3 which has a setting wheel 15 with spiral setting cam 16, a rocker lever 18 engaging by a projection 17 into the setting cam 16, a link 19, and a crank 20. Crank 20 is arranged on a setting shaft 21 of the stitch-setting device 14.

The circumference of the setting wheel 15 is provided with a worm gear serration 22, into which a worm 23 engages. Worm 23 is secured on the shaft 24 of a step motor 25, which is arranged adjustably on a plate 26 fastened on the sewing machine.

Axially of the setting shaft 21 there is arranged on the sewing machine a potentiometer 27 whose setting element 28 is fastened in an axial bore of the setting shaft 21. Potentiometer 27 is connected via a line 29 to an input of a microcomputer 30.

On the top side of head 2 a plate 31 extending substantially horizontally is fastened, which carries a vertically running stud 32 and spaced therefrom a vertically extending plate 33. On stud 32, which is aligned with the axis of needle 5, a fork type support 34 is rotatably mounted. Support 34 has an upper forked projection 35 and a lower forked projection 36.

Between the upper leg 37 and the lower leg 38 of support 34, a worm gear 39 is rotatably mounted on stud 32. The worm gear 39 is secured on a flat eye 40 of the lower leg 38 and is thus non-rotationally connected with the support 34. Engaging into the worm gear 39 is a worm 41 which is fastened on the shaft 42 of a step motor 43 arranged on plate 33.

In the lower projection, on a stud 44, a lever 45 is pivotably mounted. In the lower bent end 46 of lever 45 a double action cylinder 47 is arranged. At the piston rod 48 of the pneumatic cylinder 47 a pressure piston 49 coming to a point at the lower end is fastened.

In the upper end 50 of lever 45 which widens to an eye (or lug), a spherical threaded bushing 51 is pivotably mounted. In the threaded bushing 51 a threaded spindle 52 is received, which is rotationally connected to the shaft 53 of a step motor 54. The step motor 54 is mounted pivotably in the upper projection 35 by means of two bolts 55.

The microcomputer 30 is connected on the output side, via lines 56, 57 and 58, to control circuits (not shown) of the step motors 25, 43 and 54. Another output of microcomputer 30 is connected via an amplifier (not shown) and a line 59 to the switching magnet of a 4/2-way valve 60. The multi-way valve 60 is connected via two hose lines 61, 62 to the pneumatic cylinder 47. The compressed air source is marked 63.

On lever 45 a switching lug 64 is fastened which cooperates with a slit initiator 65. The initiator 65 is arranged on an angle plate 66 fastened on the support 34 and is connected via a line 67 to an input of microcomputer 30. At the support 34 a switching lug 68 is fastened, which cooperates with a slit initiator 69. The latter is arranged on an angle plate 70 fastened on plate 31 and is connected via a line 71 to another input of the microcomputer 30.

Figure 2:
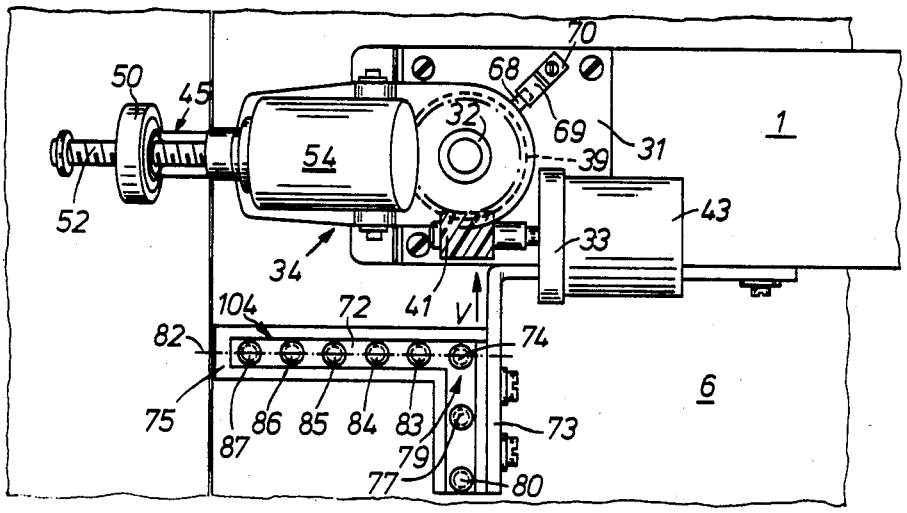
FIG. 2 is a simplified top view of a part of the sewing machine and the setting means.

On an L-shaped support 72, which is arranged on a cranked angle plate 73 fastened on arm 1, a sensor 74 is fastened in spaced relation before the needle bar 4. The sensor 74 consists in known manner of a light transmitter and a light receiver. It cooperates with a reflection foil 75 fastened on the base plate 6 (FIG. 2) and is connected via a line 76 to an input of microcomputer 30. Spaced from the sensor 74 there is arranged on support 72 a second, similar sensor 77, which is connected via line 78 to an input of microcomputer 30 and together with sensor 74 forms part of a feed measuring device 79. In spaced relation before sensor 77 there is arranged on support 72 a third, similar sensor 80, which is connected via a line 81 to an input of microcomputer 30. Sensors 74,77 and 80 are aligned with the feed direction V and with the needle 5.

On support 72, laterally of sensor 74, there are arranged further, on a line 82 extending crosswise to the feed direction V, five similar sensors 83 to 87, which are spaced from each other and are connected via lines 88 to 92 to corresponding inputs of microcomputer 30. The sensors 83 to 87 form a scanning device 104 for the edges of the workpiece W.

Figures 3, 4:
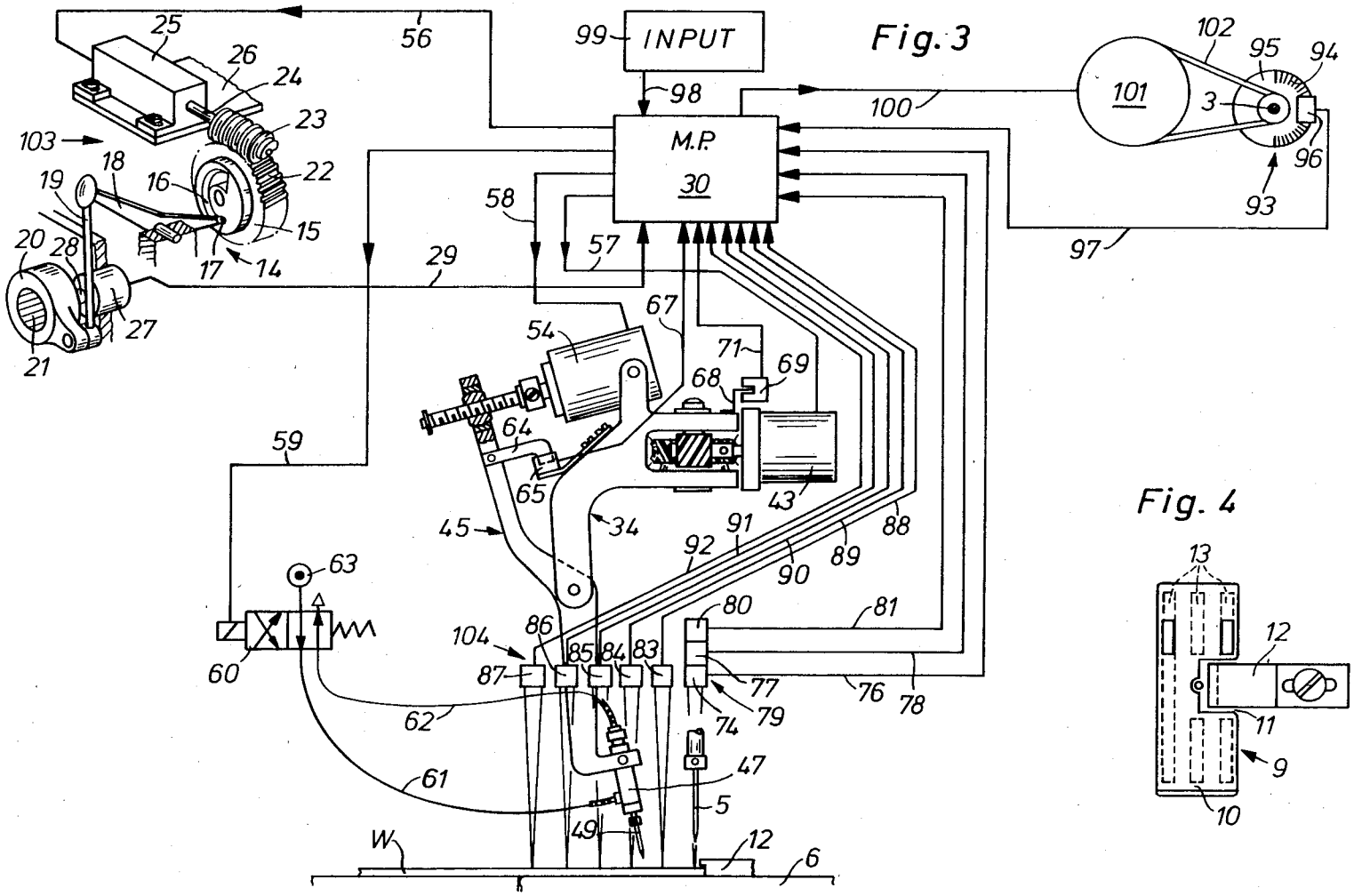
FIG. 3 is a schematic representation of various elements of the sewing machine, of the guiding and scanning devices and their mutual connection.
FIG. 4 is a top view of the sole of the sewing foot and the guide ruler.

A pulse generator 93 illustrated schematically in FIG. 3 contains a strobe disc 95 fastened on the main shaft 3 and provided with a plurality of stroke marks 94 as well as a light-scanning head 96 responding to the stroke marks 94. The pulse generator 93 is connected via a line 97 to an input of microcomputer 30. The stroke marks 94 are present only on a portion of the strobe disc 95, namely that portion which during the transport phase of the feed dog 13 passes through the light scanning head 96.

At the microcomputer 30, an input equipment shown schematically in FIG. 3, equipped with a keyboard for input of data, is connected via a line 98. An output of microcomputer 30 is connected via a line 100 to a known control circuit (not shown) of a positioning motor 101, which is in drive connection with the main shaft 3 via a belt drive 102.

The microcomputer 30, the sensors 74, 77, 80, 83 to 87, the pulse generator 93 and the step motor associated with the stitch setting device 14 are components of a corner stop system 103 which makes it possible to stop the sewing machine with the needle 5 inserted in a predetermined seam corner point.

The sewing machine operates as follows:

Before sewing is started, the seam spacing from the workpiece edge is fixed, if desired, by adjusting the lateral distance of the guide ruler 12 from the needle 5, and the selected value is entered in the microcomputer 30 via the input equipment 99. Also entered in the microcomputer 30 via the input equipment 99 is the size of the stitch length with which the seam is to be formed. Thereupon the microcomputer 30 gives the step motor 25 respective control commands, whereby the latter rotates the setting wheel 15 of the stitch-setting device 14 and in this manner adjusts the respective feed movement of the feed dog 13. The rotary movement of the setting shaft 21 occurring upon adjustment of the stitch length brings about an analogous variation of the resistance of the potentiometer 27 connected with the setting shaft 21. This value, which simulates the adjusted value, is sent to the microcomputer 30 also.

During sewing, the workpiece W is continuously scanned by the sensors 74,77,80 and 83 to 87. As long as the workpiece edge present in the scanning region of the sensors is straight, the reflection foil 75 remains covered at the scanning points. The pneumatic cylinder 47 with the pressure piston 49, the step motor 43 with the support 34, and the step motor 54 with the lever 45 remain in the starting position shown in the drawing.

Due to the slight friction of the workpiece on the base plate 6 or respectively on the surface of a sewing table (not shown) carrying the sewing machine, the feed dog 13 executing the feed movement causes at the workpiece a rotational moment or torque, whereby the workpiece edge to be worked is automatically held in abutment at the guide ruler 12. According to the same principle also concavely arcuate sections of the workpiece edge are controlled automatically.

When a straight follow-up edge of the workpiece W extending at an angle to the edge being worked approaches the sewing foot 9, the follow-up edge first passes under the front sensor 80. As soon as the reflection foil 75 is exposed in the scanning point of sensor 80, the sensor 80 delivers a switching pulse to the microcomputer 30. Thereupon the latter switches the positioning motor 101 to a predetermined low speed, at which the sewing machine can later be stopped without delay.

Thereafter the follow-up edge of workpiece W passes under the sensor 77. The switching pulse of sensor 77 brings about that from this time on the pulses, generated by the pulse generator 93 always only during the transport phases, are added in a register of the microcomputer 30, and this continues until the follow-up or trailing edge of the workpiece passes under the rear sensor 74 and the latter delivers a switching pulse to the microcomputer 30 upon clearing of the reflection foil 75 in the scanning point. The sum of the pulses of pulse generator 93 thus determined, which corresponds to the actual movement of the workpiece W, is compared with a number of pulses calculated by the microcomputer 30 at the same time, which results by dividing the distance between the scanning points of the sensors 74,77 by a factor permanently stored in the micrcomputer 30 and depending on the adjusted stitch length. In this way the actual forward step size of the workpiece W per stitch is determined.

Subsequently the follow-up edge of workpiece W passes through the scanning points of the sensors 83 to 87. If the follow-up edge is oriented at right angles to the workpiece edge being worked, the sensors 83 to 87 deliver a switching pulse simultaneously. But if the follow-up edge extends at an obtuse or an acute angle to the workpiece edge being worked, the sensors 83 to 87 deliver their switching pulses one after the other at intervals of time. The size of the angle between the two workpiece edges corresponds to the particular sum of the pulse generator 93 registered between the response of two adjacent sensors 83, 84; 84, 85; 85, 86; 86, 87. If the singly formed sums of the pulses are equal, it follows that the follow-up edge is rectilinear in the scanning region.

After determination of the geometric form of the section of workpiece W present in front of the sewing foot 9 and of the direction or orientation of the follow-up edge, the microcomputer 30, taking into consideration the selected seam spacing, the adjusted stitch length, and the previously determined actual forward step size of the workpiece W calculates the number of stitches still to be sewn as well as the stitch length required so that the last stitch of the seam section being worked will lie in the desired seam corner point. Approach of the seam corner point here takes place similarly as described in German OS No. 32 16 993.

When the seam corner point is reached, the sewing machine is stopped with the needle 5 inserted in the workpiece W, by signal delivery of microcomputer 30 to the positioning motor 101. Thereafter the microcomputer 30 brings about a switching of the multi-way valve 60, whereupon the pneumatic cylinder 47 lowers the pressure piston 49 onto the workpiece W. Following this, the micrcomputer 30 actuates the step motor 43, whereupon the latter, by way of the worm 41 and worm gear 39, swivels the support 34 with the lever 45 and the pressure piston 49 around the stud 32. The swivel movement of the pressure piston 49 is transmitted to the workpiece W, owing to which the latter rotates about the axis of needle 5. The swivel movement of the pressure piston 49 is such, as a function of the previously measured angle between the two workpiece edges converging in the corner point, that after completed rotary movement of the support 34 or of the pressure piston 49 the follow-up edge of workpiece W applies against the guide ruler 12 and runs parallel to the feed direction V.

To enable the workpiece W to follow the rotary motion of pressure piston 49 unrestrictedly, it may be desirable to slightly raise the sewing foot 9 during this time or to reduce the pressing force of foot 9.

After rotation of the workpiece W, the pressure piston 49 is raised again and support 34 is pivoted back to the starting position determined by the slit initiator 69. After the lifting of the pressure piston 49 the positioning motor 101 is turned on again by the microcomputer 30 and thus the sewing process is continued.

If now a convexly arcuate edge section of workpiece W approaches the sewing foot 9, this edge section again passes first under sensor 80, whereupon the positioning motor 101 is switched back to the predetermined low speed. Thereafter the arcuate edge section passes successively under the two sensors 77, 74, whereby again the actual forward step size of workpiece W per stitch is measured.

Subsequently the arcuate edge section passes under sensors 83 to 98. Due to the arched form of the edge pattern, the sensors 83 to 87 will now send their switching pulses after the passage of different feed distances, whereupon the microcomputer 30 calculates the geometric form, i.e. the size of the radius of the arc as well as the arc length, from the size of the individual pulse sums formed between the response of the first and following sensors 83 to 87. In accordance with the size of the radius thus determined, the microcmputer 30 now actuates the step motor 54, whereupon the latter, via the threaded spindle 53, displaces the lever 45 in such a way that the distance between the set-down point of the pressure piston 49 on the workpiece W and the axis of needle 5 is somewhat greater than the result from the subtraction between the previously determined radius of the arc and the seam spacing.

As soon as the workpiece W has been advanced so far that the radius point of the arcuate edge section is under the pressure piston 49, the latter is set down on the workpiece W in the manner already described above. With the sewing machine continuing to run, the cloth feed dog 13 brings about a rotary movement of workpiece W, the tip of piston 49 forming the center of rotation. Since the adjusted distance between the set-down point of piston 49 and the axis of needle 5 had been selected somewhat greater than would correspond to the theoretical value, the workpiece edge is pressed lightly against the guide ruler 12 during the rotation. Owing to this, disturbing influences, which are caused for example by friction, can have no adverse effect on the alignment result.

The period during which the pressure piston 49 rests on the workpiece W as center of rotation depends on the previously determined length of the arcuate edge section. As soon as the feed dog 13 has moved the workpiece by a corresponding amount, i.e. rotated in the seam region, the microcomputer 30 causes the pressure piston 49 to be pulled back into its starting position again. If the convexley arcuate edge section is followed by a straight or a concavely arcuate edge section, sewing can continue without interruption at normal speed. The step motor 54 then moves the lever 45 back into the starting position determined by the slit initiator 65.

The geometric form of the workpiece edge can be determined more accurately, the more sensors are used therefor and the closer their scanning points are together. A further possibility for determining the geometric form consists in using so-called image sensors, which are designed either as line or as area image pickup sensors and create an exact reproduction, consisting of a plurality of electrical signals, of the workpiece edge to be observed, which reproduction is then evaluated by the microcomputer 30.

While a specific embodiment of the invention has been shown and described in detail to illustrate the application of the principles of the invention, it will be understood that the invention may be embodied otherwise without departing from such principles.

What is claimed is:

1. A sewing machine comprising:

positioning means for positioning a sewing needle;

a feed dog for feeding a workpiece having a workpiece edge and a corner point, past the needle in a feeding direction;

scanning means for scanning the workpiece and for recognizing the workpiece edge;

a pressure piston spaced laterally of the needle with respect to the feed direction;

setting means connected to the pressure piston for lowering the pressure piston so that it can be brought into contact with the workpiece;

stopping means connected to said positioning means for stopping the positioning means with the needle inserted in the corner point of the workpiece; and pivot means connected to said pressure piston for pivoting said pressure piston about an axis of said needle when said setting means lowers said pressure piston.

2. A sewing machine according to claim 1, including guide means for automatically making an edge-parallel seam and including a guide ruler against which the workpiece edge slides in the feeding direction with movement of said feed plate.

3. A sewing machine according to claim 1, wherein said pivot means comprises a support mounted for pivoting about the axis of said needle, said pressure piston being connected to said support, and second setting means engaged with said support for pivoting said support about the axis of said needle.

4. A sewing machine according to claim 3, including a lever pivotally mounted to said support and carrying said pressure piston, and third setting means operatively connected to said lever for pivoting said lever to adjust a lateral distance between said pressure piston and said needle.

5. A sewing machine according to claim 4, wherein said scanning means is capable of determining the geometric form of the workpiece edge and comprises sensors for sensing a measuring field extending transversely to said feeding direction, and a microprocessor connected to said measuring field for evaluating measured data, said microprocessor being connected to said first mentioned, second and third setting means for controlling the position of said pressure piston.

6. A sewing machine according to claim 5, wherein said measuring field includes a plurality of discrete sensors spaced with respect to each other on a line extending transversely to the feeding direction.

7. A sewing machine comprising a positioning device for positioning a needle of the sewing machine, at least one feed dog for feeding a workpiece, a guide device for automatically making an edge-parallel seam with a guide ruler for a workpiece edge, a scanning device for recognizing the workpiece edge, a pressure piston spaced laterally from the needle, setting means for lowering the pressure piston, stopping means connected to the positioning drive for stopping the drive with the needle inserted in a seam corner point of the workpiece, and displacement means connected to the pressure piston for pivoting the pressure piston about an axis of the needle.

8. A sewing machine according to claim 7, wherein said displacement means comprises a support pivotally mounted about the axis of said needle and a second setting means connected to said support for pivoting said support about the axis of said needle.

9. A a sewing machine according to claim 7, wherein said displacement means includes a pivotally mounted lever for supporting said pressure piston and further setting means connected to said lever for pivoting said lever to change a lateral distance between said pressure piston and said needle.

10. A sewing machine according to claim 7, wherein said scanning device includes a measuring field extending crosswise to a direction in which said feed dog feeds the workpiece and which includes a plurality of spaced measuring sensors, and a microprocessor connected to said measuring sensors for evaluating data therefrom and connected to said setting means for actuating said setting means in accordance with the data.

* * * * *